United States Patent [19]

Poirier

[11] 4,363,944

[45] Dec. 14, 1982

[54] METHOD OF PREVENTING UNINTENTIONAL ACTUATION OF A LIGHT SWITCH

[76] Inventor: Earl J. Poirier, 149 W. Broadway, Monticello, Minn. 55362

[21] Appl. No.: 308,831

[22] Filed: Oct. 5, 1981

Related U.S. Application Data

[63] Continuation of Ser. No. 180,670, Aug. 25, 1980, abandoned.

[51] Int. Cl.[3] ..... H01N 27/00

[52] U.S. Cl. ..... 200/42 R; 200/304; 200/334; 220/242

[58] Field of Search ..... 200/42 R, 304, 333, 200/334; 220/242

[56] References Cited

U.S. PATENT DOCUMENTS

| | | | |
|---|---|---|---|
| 2,813,938 | 11/1957 | Speizman | 200/42 |
| 2,880,264 | 3/1959 | Ruskin | 174/67 |
| 3,491,327 | 1/1970 | Tait et al. | 339/36 |
| 3,527,149 | 9/1970 | Spacek | 200/42 R |
| 4,102,471 | 7/1978 | Lore et al. | 220/222 |

*Primary Examiner*—Willis Little

*Attorney, Agent, or Firm*—Kinney, Lange, Braddock, Westman & Fairbairn

[57] ABSTRACT

A method of applying a switch guard device to a wall switch to prevent unintentional actuation of the wall switch. The wall switch has an actuating lever extending through an aperture in a switch plate with the switch plate normally being attached to the wall switch on opposite sides of the actuating lever by screw threaded fasteners. The switch guard device is formed from a flexible body portion, initially relatively flat, having a pair of spaced apart apertures for receiving the threaded fasteners. The spaced apart apertures are spaced a sufficient distance that when the threaded fasteners are received by the spaced apertures attaching the body portion to the switch plate, the body portion flexes into an arcuate configuration covering the actuating lever sufficiently to prevent accidental movement of the lever but to allow intentional movement of the lever. The switch guard is applied by removing the threaded fasteners, fastening one end of the flat body portion to the switch by passing one of said fasteners through one of the spaced apertures, flexing the body portion until the other of the spaced apertures is aligned with the opening for the other threaded fastener, and securing the guard device by passing said other threaded fastener through said other of the spaced apertures and tightening said fastener.

4 Claims, 4 Drawing Figures

METHOD OF PREVENTING UNINTENTIONAL ACTUATION OF A LIGHT SWITCH

This application is a continuation of my application Ser. No. 180,670, filed Aug. 25, 1980, now abandoned.

BACKGROUND OF THE INVENTION

1. Field of the Invention

The present invention relates to a switch guard for protecting a wall switch, and in particular, it relates to a method of attaching such a switch guard by flexing a flat member and attaching it to the switch plate by the same screws that hold the switch plate to the switch.

2. Description of the Prior Art

Wall switches that are typically found in both residential and commercial buildings for controlling electric currents have actuating levers that protrude through an aperture in a switch plate. The actuating lever is subject to inadvertent displacement to either the "ON" or "OFF" position, which may either allow electrical energy to flow or shut off the flow of electrical energy, respectively. The chance of inadvertent displacement of the switch lever is multiplied in the situation where there are multiple adjacent switches protected by one switch plate.

The unintentional actuation of the switch may pose a safety hazard where the switch controls the electricity to hazardous shop machinery. Accidental or unintentional actuation of the switch may pose serious hazards to persons in the proximate vicinity of such hazardous machinery. Also, the deactivation of the switch, shutting off the electricity, may pose serious economic losses, such as the shutting off of a compressor of a refrigeration unit which is protecting perishable goods.

In addition, the unconscious actuation of switches causes waste of electrical energy. Switches are often turned on when walking into a room from habit whether the room needs light or not. Multiple adjacent light switches in the home result in the accidental turning on of more switches than necessary, further wasting energy.

In the prior art, several devices have been developed for safety and energy conservation with regard to standard household switch configurations. However, these prior art devices have not solved the problem of uninentional actuation of switches as is demonstrated by the general nonuse of these devices.

The Tait et al U.S. Pat. No. 3,491,327 shows a safety cover for an electrical plug outlet which is attached to the faceplate of the electrical outlet by flanges that engage the back of the faceplate. The safety cover is engaged and disengaged by sliding the flanges between the wall and the back of the faceplate and makes accessibility to the outlets difficult since it would be almost completely enclosed. Further, the box-like structure of the safety cover of the Tait et al patent would provide minimal visibility as to the position of a switch if used as a switch guard.

The Ruskin U.S. Pat. No. 2,880,264 shows a box-type safety cover which engages a specially designed or modified outlet plate cover. Even though accessibility to the outlet plate is better than in the Tait et al patent, the cost of a specially designed cover plate is a sufficient deterrent to the use of the fixture assembly of the Ruskin patent. Moreover, the device of either Tait et al or Ruskin would not be suitable for use with a switch since it would be necessary to remove the cover whenever the switch was to be actuated.

The Speizman U.S. Pat. No. 2,813,938 teaches a switch guard having an arcuate body portion with a slot, with the slot being engaged by a screw which holds a switch lever engaging clamp 27. The clamp and the arcuate body portion hold the switch lever in one position, as shown in FIGS. 1 and 2. To move the switch lever 21, screw 26 must be loosened and moved along slot 25 thereby moving the switch lever 21 to the other position. The switch guard of the Speizman patent provides a bothersome switch guard in that a screwdriver must be carried to move the position of the switch lever. Also, FIGS. 4 and 6 show a switch guard without the slot and screw elements but with a permanently positioned lever engaging clamp 31. The second form of the switch guard of the Speizman patent has the disadvantage of having to be removed from the switch lever in order to move the switch lever. Removal of the switch guard creates a situation where the switch guard may not be placed back to engage and protect the switch lever.

The Spacek U.S. Pat. No. 3,527,914 teaches a toggle switch guard. Unlike toggle switches, wall switches do not have a central threaded base and nut to secure the switch guard, as shown in FIG. 1 of the Spacek patent. Further, the Spacek switch guard is fabricated from spring steel to serve as a lock washer for nut 38, thus requiring a special forming operation.

The Lore et al U.S. Pat. No. 4,102,471 shows several forms of switch guards having a box-like configuration in FIGS. 1–5. The Lore et al patent teaches that the configuration of the switch guard of FIG. 4 may also have two fully open sides for access to the actuating lever. However, the switch guard of the Lore et al patent is made of a rigid or semi-rigid material which requires a relatively expensive process. Moreover, the bulkiness of a rigid or semi-rigid structure adds to shipping and packaging costs, hindering the sale or distribution of the switch guard.

SUMMARY OF THE INVENTION

The switch guard of the present invention is in the form of a flexible body portion, being initially relatively flat, having a pair of spaced apart apertures for receiving the threaded fasteners of a conventional switch, the spaced apart apertures being spaced a sufficient distance so that when the threaded fasteners are received by the spaced apart apertures attaching the body portion to the switch plate, the body portion flexes into an arcuate configuration covering the actuating lever sufficiently to prevent accidental actuation of the lever, but to allow intentional actuation of the lever.

The switch guard of the present invention serves as a protective cover, preventing accidental movement of the actuating lever of the wall switch. The switch guard is easily secured to a standard switch plate without any modification thereto by fastening the switch guard by the screws used to hold the switch plate in place. The position of the actuating lever when protected by the switch guard can be viewed from a distance because of the open sides. The flexed body portion of the switch guard flexes sufficiently when installed to allow the actuating lever to be moved without interference from one position to another, but with the conscious regard that the user is doing so.

DETAILED DESCRIPTION OF THE PREFERRED EMBODIMENTS

Figure 1:
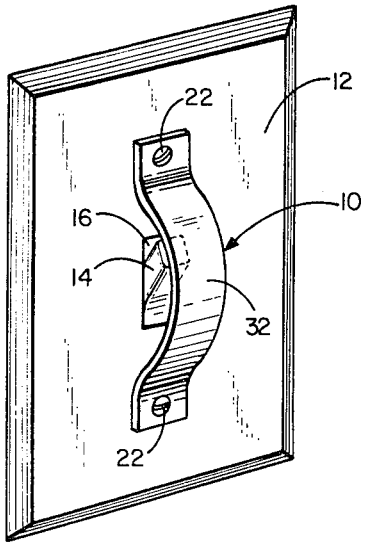
FIG. 1 is a perspective view of the switch guard attached to a wall switch plate of the present invention.
Figure 3:
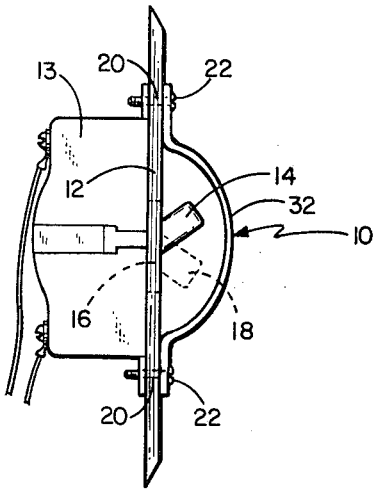
FIG. 3 is a side view of the switch guard attached to a switch plate of a wall switch.
Figure 2:
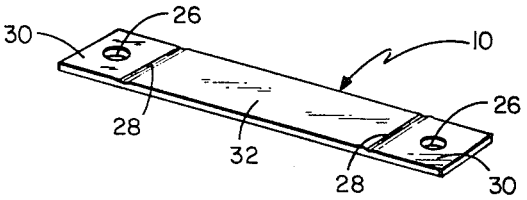
FIG. 2 is a perspective view of the switch guard before attachment to a switch plate.

A switch guard, generally indicated at 10, is shown in FIGS. 1–3. Switch plate 12 is a standard switch plate that is used to cover the switch 13 shown in FIG. 2, the switch having an actuating lever 14.

Switch plate 12 has an aperture 16 large enough for actuating lever 14 to protrude therethrough and to move from one position to another, as indicated by broken line 18. The switch plate 12 has apertures 20 for receiving screws 22 which fasten the switch plate to the switch 13, switch 13 having threaded apertures to receive screws 22. Screws 22 are located on opposite sides of lever 14 and are typically $2\frac{3}{8}$ inches from each other, center-to-center. Switch cover plate 12 may be a plain plastic switch cover or a decorative cover made of a combination of materials.

The switch guard of the present invention is a flexible body, preferably a thin rectangular strip, with a pair of spaced apart apertures 26. The spaced apart apertures 26 have a diameter slightly greater than the diameter of the shanks of screws 22 so that the screws 22 can extend through apertures 26 when the switch guard is attached to the switch plate 12.

Creases 28 (slightly exaggerated as shown in FIG. 2) are scored into the switch guard dividing the guard into tab portions 30 and a flexing portion 32. The creases aid in the flexing portion 32 flexing to the proper arcuate configuration by minimizing any side movement of the portion 32 upon attachment to the switch plate 12. In addition, the creases keep the switch guard 10 in a protective arcuate configuration after it is attached to the switch plate 12 by screws 22.

The switch guard 10 is initially relatively flat as best seen in FIG. 2. Being relatively flat when unattached to the switch plate allows the switch guard 10 to be distributed cheaply without costly packaging. For example, the switch guard can be distributed by mail as part of an advertising campaign by a bank or utility in the same envelope as their monthly statements to their customers. Thus, the switch guard's relative initial flatness provides an inexpensive method of distribution thereby increasing the usage of the switch guard.

Switch guard 10 is preferably produced from a polyallomer, a synthetic polymer. One such suitable polyallomer is known as Tenite manufactured by Eastman Kodak Company. However, the switch guard 10 may be produced from any suitable material including other polymeric materials that have the integrity and the flexibility sufficient to fulfill the purpose of the present invention. The switch guard 10 is preferably manufactured by a compression molding process due to its relative flatness, but any conventional process is within the scope of the invention. Generally the switch guard will be the color of the switch plate, but any color is contemplated, such as red for emergency use, or blue for maintenance. In addition, words, phrases or symbols may be affixed to the outside surface of the switch guard to convey a message.

A typical example of the switch guard 10 used with the standard switch plate having apertures whose centers are $2\frac{3}{8}$ inches apart is a rectangular strip of material approximately $\frac{3}{4}$ inch wide, approximately $3\frac{1}{2}$ inches long, and approximately 0.030 inch thick. The creases 28 are scored $\frac{1}{2}$ inch from both ends with the aperture's centers located $\frac{1}{4}$ inch from both ends and $\frac{1}{4}$ inch from both creases. For a sufficient arcuate configuration of the portion 32 to occur when the switch guard 10 is attached to the switch plate, the centers of the apertures 26 are 3 inches apart. With the apertures 26 being 3 inches apart, the portion 32 flexes sufficiently in an arcuate configuration to protect the actuating lever from accidental actuation and still allow the intentional actuation of the lever. At the same time, the portion 32 does not extend out so far as to make the switch lever 14 too accessible.

Figure 4:
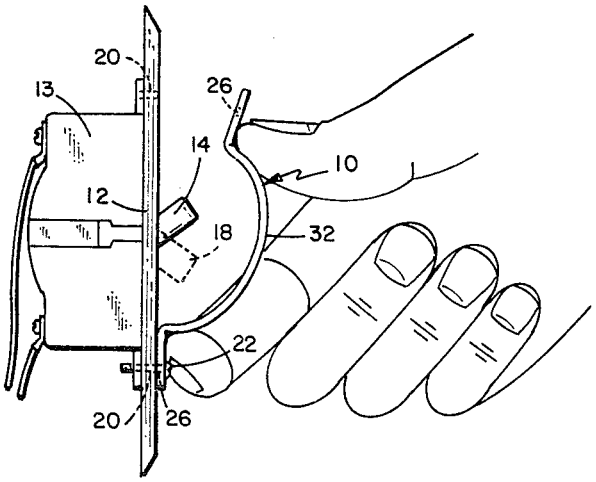
FIG. 4 is a view showing the method of attaching the switch guard.

In use, the switch guard 10 is attached to the switch plate protecting the switch 14 by removing the screws 22 and aligning the apertures 26 to the apertures 20 of the switch plate 12. Initially, one of the apertures 20 of switch plate 12 is aligned with one of the apertures 26 of switch guard 10 and screw 22 is threaded securing both guard and plate to each other, as shown in FIG. 4. When the other aperture 26 is aligned with the other aperture 20 of switch plate 12, as also shown in FIG. 4, portion 32 will flex into the arcuate configuration indicated in FIGS. 1, 2, and 4. Then the other screw 22 is threaded through both the aperture 26 and the aperture 20, securing the guard to the cover plate.

Conclusion

The switch guard of the present invention is an economic and convenient method of both preventing accidental or unintentional activation or deactivation of a wall switch. The switch guard is easily installed without any modification to the standard switch plate that is used to cover the majority of wall switches. The relative flatness of the switch guard permits an economical manufacturing thereof and an inexpensive method of distribution to the user. The switch guard is easily installable, but is sufficiently attached to the switch plate as to not be readily removable, thereby providing protection against inadvertent displacement of the actuating lever of the switch.

Although the present invention has been described with reference to the preferred embodiments, persons skilled in the art will recognize that changes may be made in form and detail without departing from the spirit and scope of the invention.

What is claimed is:

1. A method of preventing unintentional actuation of a wall switch of the type having an actuating lever protruding through an aperture in a switch plate, said switch plate being attached to the wall switch on opposite sides of the actuating lever by a pair of screws spaced apart a predetermined distance, the method comprising:

providing a thin flexible body member having a flat configuration throughout its length and a pair of spaced apart apertures for receiving said screws, said spaced apart apertures being spaced apart a distance substantially greater than the predetermined distance between the screws of the wall switch such that when the threaded fasteners are received by the spaced apart apertures attaching the body member to the switch plate, the body member flexes from said flat configuration into an arcuate configuration covering the actuating lever sufficiently to prevent accidental actuation of the lever but to allow intentional actuation of the lever, and removing said screws from the wall switch, placing said flat body portion over the switch plate with one of the apertures through the body member aligned with one of the screws through the wall plate, inserting one of the screws through the aligned opening in the body member and the wall plate and tightening said screw, flexing the central portion of the body member outwardly from said flat configuration into such an arcuate configuration and positioning said body member such that the other aperture of the body member is aligned with the other screw opening through the wall plate, and inserting the other screw through the other aligned opening and tightening said other screw to maintain the body member and the switch plate in position.

2. The method of claim 1 in which said body member has a pair of creases in the upper wall thereof to form tabs on opposite ends of the flexible body portion, said creases facilitating the flexing of the body portion outwardly and maintaining the tabs flat against the switch plate.

3. The method of claim 1 in which the body portion is of a synthetic polymeric material having sufficient flexibility to be flexed into such an arcuate configuration.

4. The method of claim 1 in which the switch plate has apertures with screw threaded fasteners with centers $2\frac{3}{8}$ inches apart and the spaced apart apertures are spaced approximately 3 inches from center to center thereby providing for such an arcuate configuration when the body member is fastened in position by the screw threaded fasteners.

* * * * *